US006014773A

United States Patent [19]

Banks

[11] Patent Number: 6,014,773

[45] **Date of Patent: *Jan. 18, 2000**

[54] MONITORED STATIC ELECTRICITY DISSIPATION GARMENT

[76] Inventor: David L. Banks, 7362 W. 87th St., Los Angeles, Calif. 90045

[ * ] Notice: This patent is subject to a terminal disclaimer.

[21] Appl. No.: 09/208,366

[22] Filed: Dec. 10, 1998

[51] Int. Cl.[7] ..... H05F 3/02; A41D 13/02

[52] U.S. Cl. ..... 2/69; 2/227; 2/79; 361/212; 361/220

[58] Field of Search ..... 2/69, 1, 79, 227; 428/256, 259, 381; 174/5 SB, 5 R, 5 SG; 361/212, 220, 223, 224

[56] References Cited

U.S. PATENT DOCUMENTS 3,699,590 10/1972 Webber et al. ..... 361/220
4,422,483 12/1983 Zins ..... 139/420 R
4,596,053 6/1986 Cohen et al. ..... 361/220
5,440,444 8/1995 Adams ..... 361/220
5,548,469 8/1996 Adams ..... 361/220

*Primary Examiner*—John J. Calvert
*Assistant Examiner*—Shirra L. Jenkins
*Attorney, Agent, or Firm*—Jack C Munro

[57] ABSTRACT

A monitored static electricity dissipation garment which is to be connected to a voltmeter which is to display to the wearer of the garment the amount of static electricity that is on the body of a human and garment at any given instant. The monitor can be located separate from the garment or can be worn on the garment. When using the garment of the present invention, it is preferred that the human user wear electrically conductive boots that have electrically conductive soles which function to dissipate static electricity to an electrically conductive floor. Such boots and floor are deemed to be conventional.

16 Claims, 2 Drawing Sheets

MONITORED STATIC ELECTRICITY DISSIPATION GARMENT

BACKGROUND OF THE INVENTION

1. Field of the Invention

The field of this invention relates to garments and more particularly to a garment that is designed to remove static electricity from a human user and also to remove static electricity from the garment thereby eliminating adverse affects due to static electricity in the construction of electrical equipment.

2. Description of the Prior Art

It is well known that electrons repel each other. If enough electrons are present on a given object, the expulsion force may be so great that an escape path is created, which is in the form of an arc. An electrostatic discharge, the arc, is basically a sudden and violent redistribution of electrons between two different bodies. On a human body, the electrostatic charge positions itself on the outside skin of the human body.

In the electronics industry, charged human bodies are the killer of components. Electronic components are becoming ever so more sensitive to static electricity. A human walking across the room would likely pick up hundreds of volts of static electricity. This would be a tremendously high voltage when dealing with present day electronic equipment. Present day electronic equipment of more advanced type, require that voltage be less than one volt when building or working on the equipment. If the path of the sudden electrostatic discharge happens to include sensitive electronic devices, destruction or a significant amount of damage is quite common. In the manufacturing of some extremely sensitive computer hard drives, the manufacturers are experiencing up to seventy percent rejection because of damage due to static electricity.

In the past, there has been a substantial effort expended to dissipate static electricity from workers. One of the common ways that static electricity is dissipated from a worker is by means of a conductive garment, worn by the worker, which is electrically connected to the exterior surface of the body of the worker. An electrical conductive grounding wire connects the garment to an electrical ground. Also, it is known for workers to wear shoes or boots that have electrically conductive soles.

One of the disadvantages of prior art static electricity dissipation garments is that the garment must be grounded in order for it to be somewhat effective. What is common is that the worker disconnects the ground wire to move to a different location, comes back to the first location and forgets to reconnect with the grounding outlet. Then when the worker goes back to work, static electricity flows through the electronic equipment which results in equipment damage. There is no way for the worker to ascertain that he or she has a damaging level of voltage on his or her person.

Another disadvantage of prior art static electricity dissipation garments is the lack of a positive connection between the garment and electrically conductive boots. The garment is not only to be connected to an electrical ground, but also the boots are to be used for the purpose of dissipating any static electricity in the areas of the worker's feet with this dissipation of static electricity being through the floor on which the worker is positioned. The use of the boots, which is deemed to be conventional, is important to the overall dissipation of static electricity from the garment.

Another disadvantage of prior art static electricity dissipation garments is that the worker is not able to ascertain if there is an undesirable level of static electricity on the worker's body. In the past, there has been no connection in the garment to a voltmeter, with this voltmeter to produce a reading which is to be displayed to the worker informing the worker that there is a potential damaging amount of static electricity on a worker's body.

SUMMARY OF THE INVENTION

The primary objective of the present invention is to construct a static electricity dissipation garment which is connectable to a voltage indicating device such as a voltage annunciator or a voltmeter (hereinafter called a voltmeter) so that the amount of voltage, which is on a human body, can be ascertained and an immediate determination can be made whether the voltage is at an equipment damaging level.

Another objective of the present invention is to construct a static electricity dissipation garment which connects through an electrically conductive ribbon which produces a positive discharge path so that the static electricity from the human body can be discharged effectively.

The garment of the present invention can be constructed as a pant suit, smock, frock or lab coat which is intended to be worn as an over-garment about the clothing of the human worker. The garment is manufactured to include a mass of electrically conductive threads. The garment includes a pair of sleeves each of which terminates in an electrically conductive cuff which is to be in direct contact with the human user's body. Also included within the garment is a strategic arrangement of electrically conductive ribbons which are designed to pick up static electricity from the cuffs and hence the human body from the electrically conductive threads and conduct such to a grounding source. One form of grounding source could be a grounding wire. Another grounding source could be directly through the body of the human and electrically conductive shoes or boots into an electrically conductive floor. The garment also includes a monitoring circuit that "reads" the level of the electrical voltage. The monitoring circuit is separate and spaced from the grounding circuit. The monitoring circuit is connected to a voltmeter which displays a value which represents the voltage different of the garment from the electrical ground. The voltmeter may be mounted on a workbench or other similar type of mounting position located spaced from the garment with an electrical wire being connected between the voltmeter and the garment, or the voltmeter could be manufactured to be attached directly on the garment.

DETAILED DESCRIPTION OF THE PREFERRED EMBODIMENT

Figure 1:
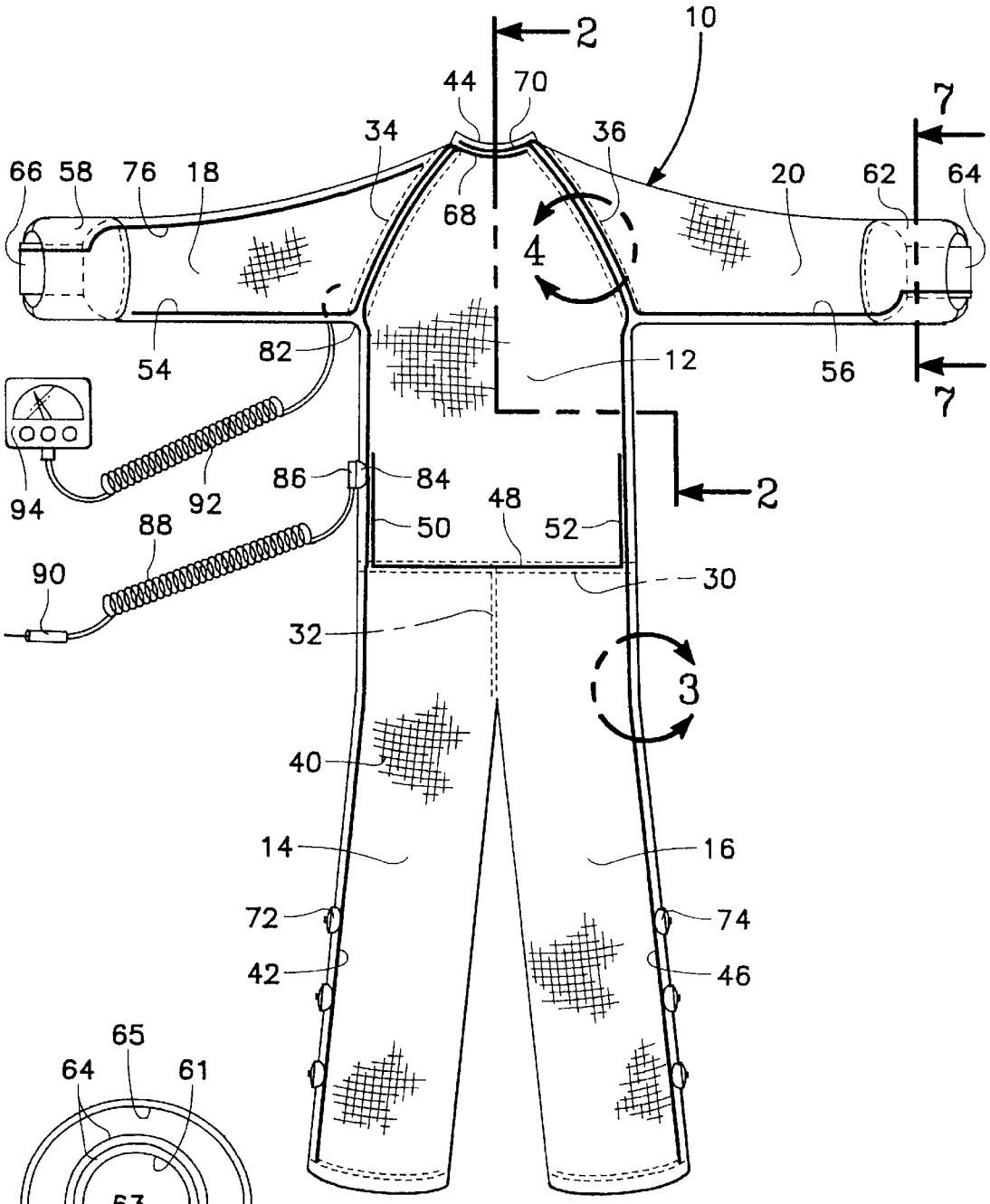
FIG. 1 is a back view of the monitored static electricity dissipation garment of this invention showing a version of the garment that is to be connected to a grounding wire and also connected to a voltmeter located spaced from the garment.
Figure 7:
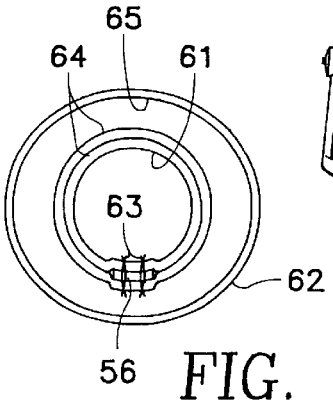
FIG. 7 is a cross-sectional view through a cuff attached to the outer end of a sleeve showing the position of the electrically conductive ribbon relative to the cuff.
Figure 2:
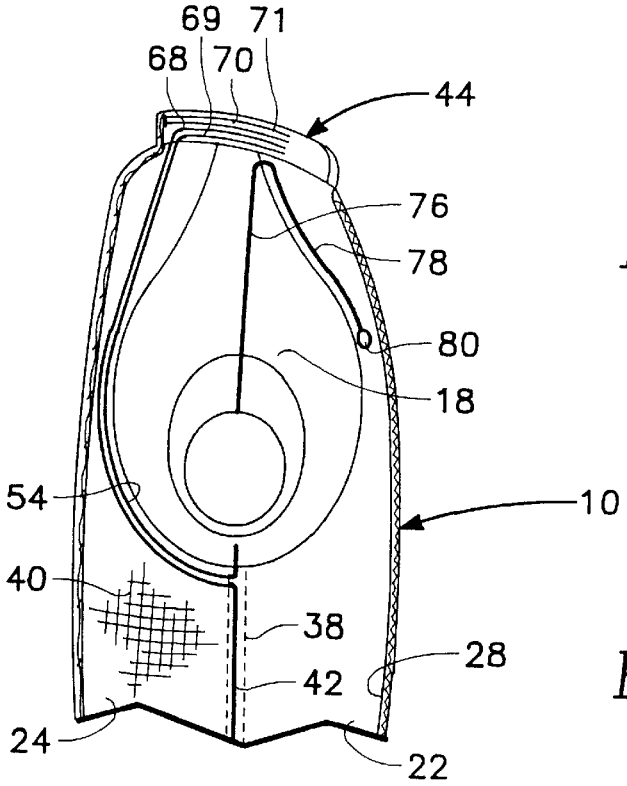
FIG. 2 is a transverse cross-sectional view through the center portion of the garment of FIG. 1 taken along line 2—2 of FIG. 1.

Referring particularly to the drawings, there is shown in FIG. 1 a pantsuit configuration of garment 10 constructed in accordance with this invention. The pantsuit 10 is formed of a torso section 12 to which are attached a pair of leg sections 14 and 16. Extending from the torso section 12 in opposite directions are a pair of sleeves 18 and 20. Although the garment is shown as a pantsuit type garment in FIG. 1, it is to be understood that the garment could be constructed in the form of a smock, frock or lab coat eliminating the leg sections 14 and 16. Referring particularly to FIG. 2, the garment 10 includes a front section 22 and a back section 24. The back section 24 is what is shown in FIG. 1. Both the back section 24 and the front section 22 are integrally connected together generally be sewing of the fabric sheet material of the pantsuit 10. Within the front section 22, there is located a zipper 26. The zipper 26 is to be unzipped exposing an internal chamber 28. The body of a human is to be located in the internal chamber 28 with generally the garment 10 being worn as an over-garment.

The leg sections 14 and 16 are joined at the torso section 12 at a cross seam 30. The leg sections 14 and 16 are also joined together at a crotch seam 32. Sleeve 18 is attached to the torso section 12 at a sleeve seam 34. The sleeve 20 is attached to the torso section 12 at a sleeve seam 36. The leg sections 14 and 16 are of the same length and are located in juxtaposition. The sleeves 18 and 20 are also of the same length and are in alignment with each other but extend in opposite directions relative to the torso section 12. The torso section 12 and the leg section 14 include a continuous side seam 38 which connect together the front section 22 to the back section 24. A similar such side seam (not shown) is used to connect the front section 22 to the back section 24 for the leg section 16 in the torso section 12.

A typical material of construction for the entire pantsuit 10 would be a thermal plastic type of material such as a polyester within which are woven strands 40 of electrically conductive fiber usually of silver or carbon. Typically, the strands 40 are spaced about one-quarter of an inch apart and are located in a crisscross pattern forming a checkerboard appearance. Formed within the garment 10 is a grounding circuit whose function is to dissipate static electricity from the garment 10 as well as from the human that is located within the internal chamber 28. This grounding circuit utilizes in part an electrically conductive ribbon 42 which extends substantially the entire length of the pant leg section 14 and up into the sleeve seam 34 and into collar 44 creating ribbon segment 69. The ribbon 42 has a width of about a quarter of an inch and is about the thickness of conventional fabric. The ribbon 42 is basically constructed of a thermal plastic type fabric such as a polyester or nylon with there being incorporated within the ribbon 42 a mass of closely spaced electrically conductive fibers also of silver or carbon. The result is that the ribbon 42 comprises an exceedingly good electrical conductor. A similar such ribbon 46 extends almost the entire length of the leg section 16 and up the side seam of the torso section into the sleeve seam 36 and into the collar 44 creating ribbon segment 71.

Ribbons 42 and 46 form part of the grounding circuit. Another part of the grounding circuit is the cross ribbon 48 which is located within the cross seam 30. The cross ribbon 48 is of the same construction as ribbons 42 and 46. The cross ribbon 48 includes a right angled extension 50, at one end thereof, and a right angled extension 52 at the opposite end thereof. This right angled extension 50 is to be securely attached to the ribbon 42 with the right angled extension 52 being securely attached to the ribbon 46. It is important that the ribbon 42 to be in tight contact with the right angled extension 50 to form a positive electrical conductance therebetween. The same is true for the ribbon 46 and the right angled extension 52. A typical way that this tight connection is achieved is by a tight stitching, which is not shown. It is to be within the scope of this invention that other ways of a secure connection could be achieved, such as possibly some form of an adhesive, it just being that stitching is the simplest and most effective way to achieve a good, solid electrical conductance between the different ribbons.

Figure 3:
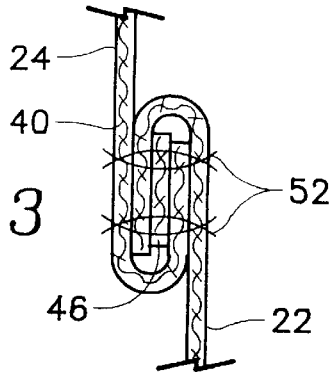
FIG. 3 is a cross-sectional view through a single layer of one of the electrically conductive ribbons mounted within the garment of FIG. 1 taken along line 3—3 of FIG. 1.

In constructing of the side seam for the leg section 16, the edge of the fabric of the front section 22 is formed into a U-shaped section with a similar such U-shaped section formed for the edge of the fabric making up the back section 24. These U-shaped sections are interlocked with each other, as shown in FIG. 3. Within the confines of the interlocked U-shaped sections, there is located the ribbon 46. Along the entire length of the U-shaped sections and the ribbon 46, there is located a mass of stitches 52. These stitches 52 securely mount the ribbon 46 in position and also securely connect to the strands 40. It is to be noted that for purposes of this invention that side seams, which include ribbons 42 and 46, are deemed to be part of the back section 24 although the ribbons 42 and 46 are actually mounted at the point of connection between the back section 24 with the front section 22.

Figure 4:
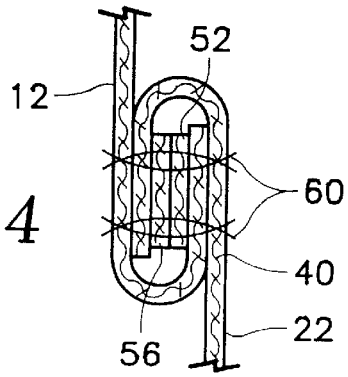
FIG. 4 is a cross-sectional view through a double layer of electrically conductive ribbons included within the garment of FIG. 1 taken along line 4—4 of FIG. 1.
Figure 5:
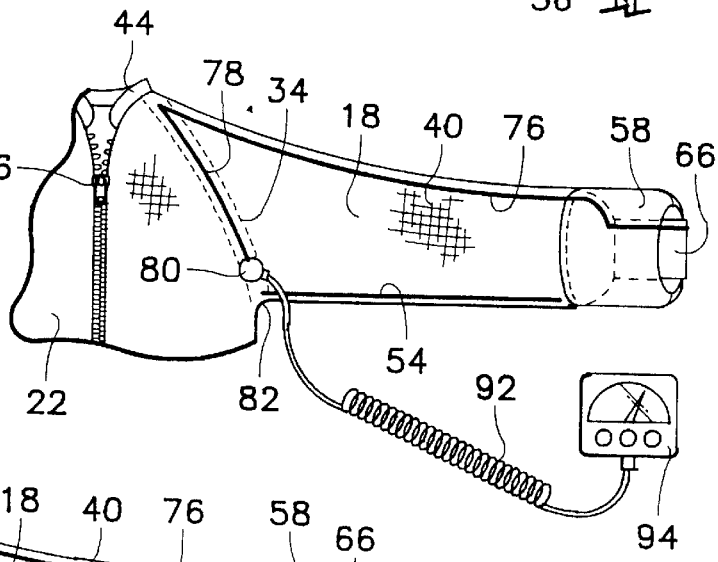
FIG. 5 is a front view of the version of the garment of FIG. 1 which clearly depicts the connection of the voltmeter to the garment.
Figure 6:
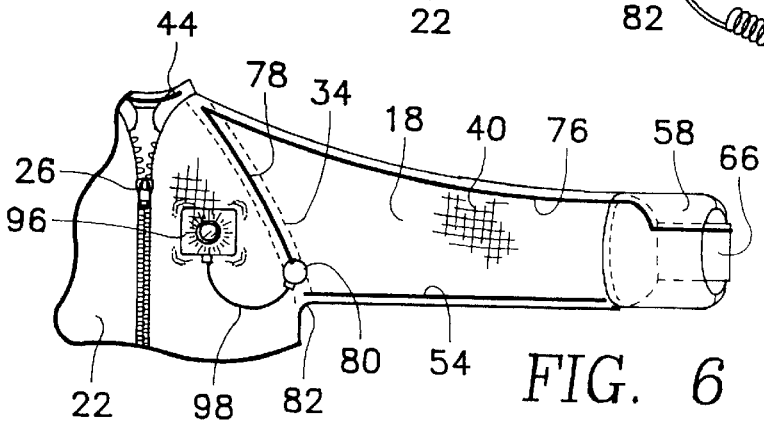
FIG. 6 is a front view similar to FIG. 5 but of a second version of the garment of the present invention where the voltmeter is mounted directly onto the garment thereby eliminating the need for the external electrical connections that are used in FIG. 1.

The function of the cross ribbon 48 is to provide a direct connection between the ribbons 42 and 46 at a point spaced from the collar 44. The grounding circuit also includes ribbons 54 and 56. Ribbon 54 is mounted within a bottom seam of the sleeve 18 with ribbon 56 being similarly mounted within a bottom seam of the sleeve 20. The ribbons 54 and 56 are essentially identical in construction to the ribbons 42 and 46. The ribbon 54 extends from a short distance spaced from a cuff cover 58 to sleeve seam 34 and then extends the entire length of the sleeve seam 34 into the collar 44. The result is in the area of the sleeve seam 34 there is a double layer of ribbons which are joined together in an overlapping arrangement with such construction being clearly depicted in FIG. 4 although FIG. 4 is directed to sleeve seam 36. In a similar manner, the ribbon 56 is mounted within the sleeve seam 36 and overlapped and secured between U-shaped sections of the sleeve 20 and the torso section 12 by stitches 60, which is clearly shown in FIG. 4. The result is that an extremely electrically positive interconnection is obtained between ribbon 56 and ribbon 52 and also between ribbon 54 and ribbon 42. One distinction between ribbon 56 from ribbon 54 is that ribbon 56 extends through the cuff cover 62 and connects with the elastic fabric cuff 64 by stitches 63. Cuff 64 is constructed of a sleeve member which is folded over upon itself capturing the ribbon 56 between the folded sections. This cuff 64, basically constructed of a polyester fabric, is impregnated with electrically conductive fibers, usually of silver or carbon. This elastic cuff 64 is to be located around the user's wrist to directly drain the body of the human of static electricity. The user's wrist is located within chamber 61. It is to be noted that ribbon 54, as previously mentioned, is spaced from the cuff cover 58 and does not connect with cuff 66 that joins to the sleeve 18. The ribbon 54 extends exteriorly of the sleeve seam 34 and forms a collar extension 68. A similar extension 70 extends from the ribbon 56. These collar extension 68 and 70 are mounted within the collar 44 and are securely stitched together in a manner similar to what is represented in FIG. 4. The cuff 64 is located within chamber 65 of cuff cover 62 with a similar construction being for cuff 66 and cuff cover 58. The cuff covers 58 and 62 do not contain impregnated electrically conductive fibers.

Mounted on the leg section 14, and connecting with ribbon 42, are three in number of snap connectors 72 which are located in a spaced-apart manner. A similar series of snap connectors 74 are mounted on the leg section 16 electrically connecting with ribbon 46. It is a function of the snap connectors 72 and 74 to connect to an electrically conductive boot or shoe so as to provide for an electrical conducting circuit from the pantsuit 10 through the boot or shoe and hence through an electrically conductive floor, which is not shown.

What has been described previously is the construction of the basic garment of this invention. This garment can comprise a pantsuit, a smock, a lab coat, and so forth. Basically, the garment will be constructed always precisely in the same manner as far as the grounding circuit is concerned. The garment will also include within the sleeve 18 a monitoring circuit in the form of an electrically conductive ribbon 76 which extends from the outer end of the cuff 66, through a seam in the upper end of the sleeve section 18 to sleeve seam 34. This cuff 66 is to also provide a static electricity drain for the body of the human. The cuff 66 is constructed similar to cuff 62. However, it is to be noted that the ribbon 76 is spaced some distance from the ribbons 42 and 54 as it is located within the portion of the sleeve seam 34 that is located within the front section 22 and not in the back section 24. The portion of the ribbon 76 that is mounted within the sleeve seam 34 of the front section 22 is referred to as number 78. This ribbon section 78 terminates in a snap fastener 80 which is mounted within the sleeve seam 34. This snap fastener 80 extends to a position near the armpit 82.

The garment of this invention can be utilized to directly connect to a grounding source by means of a snap connector 84 which is mounted in conjunction with the ribbon 42 and the right angled extension 50. A snap fastener 86 can electrically connect with the snap connector 84 with the snap fastener 86 being mounted at one end of coiled wire 88. The coiled wire 88 terminates at its free end into a plug 90. The plug 90 is to be appropriately connected to a female grounding plug, which is not shown, which usually is mounted in conjunction with a workbench or other similar type of work station.

When a human is using the pantsuit garment 10, snap fastener 80 is connected with coiled wire 92. The free end of the coiled wire 92 connects with a voltmeter 94. The face of the voltmeter 94 can be read to ascertain the precise voltage which the human and the pantsuit garment 10 is encountering at any given time. Utilizing of the pantsuit garment of this invention the voltmeter will read either a zero voltage or a voltage very close to zero.

The disadvantage of the pantsuit garment shown in FIG. 1 is that the user is restrained to a particular location. If the user wishes to move around, the user must unplug plug 90 and disconnect wire 92 from snap fastener 80. This will mean that the individual will be subject to accumulating of static electricity and may not be adequately discharged even though the individual may be wearing electrically conductive boots or shoes and standing on an electrically conductive floor. However, for an individual that requires not being connected to a particular location, a voltmeter 96 may be mounted on the front section 22 with the voltmeter 96 being connected by conductor 98 to the snap fastener 80. The dissipation of the static electricity is then subjected solely to the dissipation of the static electricity through the garment and electrically conductive boots or shoes that are to be worn by the user and through the electrically conductive floor. However, the user is able to quickly scan, at any time, the voltmeter 96 to determine if that particular individual has a damaging amount of static electricity on his or her person prior to that individual coming into direct contact with any electrical equipment which could be damaged by the static electricity.

For detailed description of electrically conductive boots which could be utilized in conjunction with this invention, reference is to be had to U.S. patent application Ser. No. 08/992,502 which was filed Dec. 17, 1997 by the present inventor. For a detailed explanation of the construction of the snap connectors 84, 72 and 80, reference is to be had to prior filed U.S. patent application Ser. No. 08/950,096, also by the present inventor.

When reference to the voltmeter 96, it is to be noted that there is no direct connection to the grounding circuit. Such devices sense ion flow in air and are commercially available from Novex Corporation of Santa Jose, Calif. Although the monitoring circuit only "reads" the left arm section 18, it should be representative of the entire human body and garment 10. The user is to be able to quickly observe and ascertain the voltage that is on the garment 10 and hence on the body. Only when the user determines that the amount of voltage is less than a predetermined value, will that individual be able to come into contact with the sensitive electronic components, which are not shown.

It is to be noted that within the boot or shoe there is to be included an electrically conductive sole, which is again not shown. Such a sole is deemed to be conventional and can be obtained from any one of several manufacturers, with one manufacturer being Stern & Stern Industries, Incorporated located in New York City, N.Y. The model number of the Stern & Stern sole is Chemstat 939PLUS.

What is claimed is:

1. A monitored static dissipation garment for a wearer comprising:

a front section adapted to be placed against the front of a wearer;

a back section adapted to be placed against the back of a wearer, said front section being attached to said back section;

said front section and said back section including a mass of electrically conductive threads;

a grounding circuit for discharging static electricity, said grounding circuit located on said back section; and a monitoring circuit for detecting the level of static electricity on said garment, said monitoring circuit located on said front section.

2. The monitored static electricity dissipation garment for a wearer as defined in claim 1 wherein:

said grounding circuit including a first electrically conductive ribbon.

3. The monitored static electricity dissipation garment for a wearer as defined in claim 2 wherein:

said monitoring circuit including a second electrically conductive ribbon.

4. The monitored static electricity dissipation garment for a wearer as defined in claim 3 including:

a voltmeter being connected to said monitoring circuit.

5. A monitored static electricity dissipation garment comprising:

sheet material adapted to be worn about the torso of a human, said sheet material being constructed of a fabric which is impregnated throughout with a plurality of electrically conductive threads;

said sheet material including a first electrically conductive ribbon forming a grounding circuit, said first electrically conductive ribbon being electrically connected to said electrically conductive threads, said grounding circuit to function as a collector of static electricity from said electrically conductive threads;

electrical discharge means connected to said garment and said first said electrically conductive ribbon, said electrical discharge means to function to remove the collected static electricity from said first electrically connective ribbon and discharge such exteriorly of said garment;

a monitoring circuit included within said garment, said monitoring circuit being separate and spaced from said grounding circuit, said monitoring circuit including a second electrically connective ribbon which is also electrically connected to said electrically conductive threads; and a voltmeter connected to said monitoring circuit, said voltmeter to produce a value representative of the residual voltage of the static electricity on said sheet material.

6. The monitored static electricity dissipation garment as defined in claim 5 wherein:

said electrical discharge means comprising a wire connector which is adapted to connect with an exterior electrical conductive ground.

7. The monitored static electricity dissipation garment as defined in claim 5 wherein:

said voltmeter being mounted on said garment and being free of any outside connection.

8. The monitored static electricity dissipation garment as defined in claim 5 wherein:

said sheet material including a sleeve, said sleeve terminating in a cuff, said cuff being electrically conductive, said cuff being in direct contact with the body of the human, said cuff being directly connected to said first electrically conductive ribbon to thereby draw static electricity from the body of the human.

9. An assembly to maintain a wearer relatively free of static electricity and to indicate operation of said assembly comprising:

a garment adapted to be worn by the wearer, said garment including:

a sheet material, means which makes said sheet material at least partly electrically conductive;

a grounding electrically conductive ribbon arrangement forming a static electricity grounding circuit, said grounding electrically conductive ribbon arrangement being electrically connected to said sheet material to conduct static electricity therefrom;

electrical discharge means adapted to be connected to an electrical ground, said electrical discharge means connected to said grounding electrically conductive ribbon arrangement to discharge static electricity from said grounding electrically conductive ribbon arrangement to the electrical ground;

a monitoring circuit included within said sheet material, said monitoring circuit including a monitoring electrically conductive ribbon, said monitoring electrically conductive ribbon being spaced from said grounding electrically conductive ribbon arrangement, said monitoring electrically conductive ribbon being also electrically connected to said sheet material; and a device connected to said monitoring electrically conductive ribbon capable of indicating differences in electrical potential between said garment and the electrical ground.

10. The assembly as defined in claim 9 wherein said garment further includes:

a first sleeve constructed from said sheet material;

a second sleeve constructed from said sheet material;

a torso constructed from said sheet material; and a first sleeve seam connecting said first sleeve to said torso, a second sleeve seam connecting said second sleeve to said torso, whereby said grounding electrically conductive ribbon arrangement is positioned within both said first sleeve seam and said second sleeve seam to make electrical contact between said sheet material of said first sleeve and said second sleeve with said torso, wherein said monitoring electrically conductive ribbon is positioned within said second sleeve seam to make electrical contact between said sheet material of said second sleeve and said torso.

11. The assembly as defined in claim 10 wherein said grounding electrically conductive ribbon arrangement includes:

a plurality of torso seams, each said torso seam making electrical contact with said sheet material of said torso.

12. The assembly as defined in claim 9 wherein:

said grounding electrically conductive ribbon arrangement being constructed of a plurality of separate ribbon members which in part are located in a stacked relationship with stitching extending tightly therethrough causing said grounding electrically conductive ribbon arrangement readily conduct static electricity along its entire length.

13. The assembly as defined in claim 9 wherein:

said device includes a connection adapted to be connected to the electrical ground and a voltmeter to indicate a level of electrical potential between said garment and the electrical ground is present.

14. The assembly as defined in claim 13 wherein:

said device located spaced from said sheet material.

15. The assembly as defined in claim 13 wherein:

said device being mounted on said sheet material.

16. The assembly as defined in claim 9 wherein:

a sleeve constructed from said sheet material, said first sleeve terminating at its outer end in a cuff, said cuff connecting with said first electrically conductive ribbon, said cuff to be in direct contact with body of the human to thereby drain static electricity from the body of the human.

* * * * *